United States Patent [19]

Collin

[11] 4,240,550

[45] Dec. 23, 1980

[54] WASHING MACHINE AGITATOR BRACE

[76] Inventor: Herbert S. Collin, 35 Stillings St., Boston, Mass. 02210

[21] Appl. No.: 105,633

[22] Filed: Dec. 20, 1979

[51] Int. Cl.[3] ..... B65D 81/06; B65D 85/00

[52] U.S. Cl. ..... 206/320; 68/3 R; 206/523; 248/351; 248/544; 410/46

[58] Field of Search ..... 68/3 R; 206/320, 523, 206/45.16; 248/351, 544; 410/2, 46, 47

[56] References Cited

U.S. PATENT DOCUMENTS

| | | | |
|---|---|---|---|
| 3,896,930 | 7/1975 | Collin | 68/3 R X |
| 3,912,076 | 10/1975 | Elwell | 206/320 |
| 3,913,736 | 10/1975 | Brennan | 206/523 X |

FOREIGN PATENT DOCUMENTS

| | | | |
|---|---|---|---|
| 986061 | 3/1976 | Canada | 68/3 R |

*Primary Examiner*—Philip R. Coe

*Attorney, Agent, or Firm*—Wolf, Greenfield & Sacks

[57] ABSTRACT

An agitator and basket for a top loading clothes washing machine is protected from damage during shipment by a plurality of rigid foam plastic braces which are arranged radially about the agitator. The inner ends of the braces are urged snugly into engagement with the upper end of the agitator of the machine and the outer ends of the braces are urged firmly into engagement with the machine housing and the upper end of the clothes basket of the machine. The inner and outer ends of the brace are of a special configuration which enhances the security and ease with which the braces engage the machine.

3 Claims, 8 Drawing Figures

WASHING MACHINE AGITATOR BRACE

BACKGROUND AND SUMMARY OF THE INVENTION

This invention relates to braces for rigidifying clothes washer agitators. A number of bracing devices have been proposed and used for years. They have taken many forms, such as corrugated cardboard elements capable of only a single use. In other instances, devices having a plurality of radially extending spoke-like elements have been employed in which each element was attached to the other by an elastic cord. More recently, a number of devices have been suggested which employ a resilient block of foam material intended to be fitted tightly, in a spoke-like array between the agitator of the machine and the upper end of the clothes basket and the machine housing. The present invention relates to an improved configuration of the foam block type agitator brace, which is somewhat simpler to manufacture and which provides improved holding and securing of the washing machine parts.

In brief, the present invention employs a number of individual braces which can be arranged in any radial spoke-like array. The blocks are formed from a resilient foamed plastic material such as foamed polyethylene. The inner end of the block is provided with a vertically extending V-shaped notch intended to engage the upper end of the agitator of the brace. A vertical extending slit is formed in the block from the bottom of the V-shaped arch and extends into the interior of the block to enable the inner wings to be spread somewhat to firmly engage the upper end of the agitator block. The outer end of the block is provided with a plurality of V-shaped grooves, each of which terminates in a horizontal slot which functions in a manner similar to the slotted V-shaped groove at the inner end of the block.

It is among the objects of the invention to provide an improved bracing device to firmly retain the agitator of top loading clothes washing machine for example, as during shipment.

Another object of the invention is to provide an improved bracing structure of the type described in which individual braces may be removed or added easily.

Another object of the invention is to provide a device of the type described which displays improved retention characteristics.

Still another object of the invention is to provide a device of the type described which is simple to use and is of inexpensive manufacture.

DESCRIPTION OF THE DRAWINGS

The foregoing and other objects and advantages of the invention will be understood more fully from the following further description thereof, with reference to the accompanying drawings wherein.

DESCRIPTION OF THE PREFERRED EMBODIMENT

Figure 1:
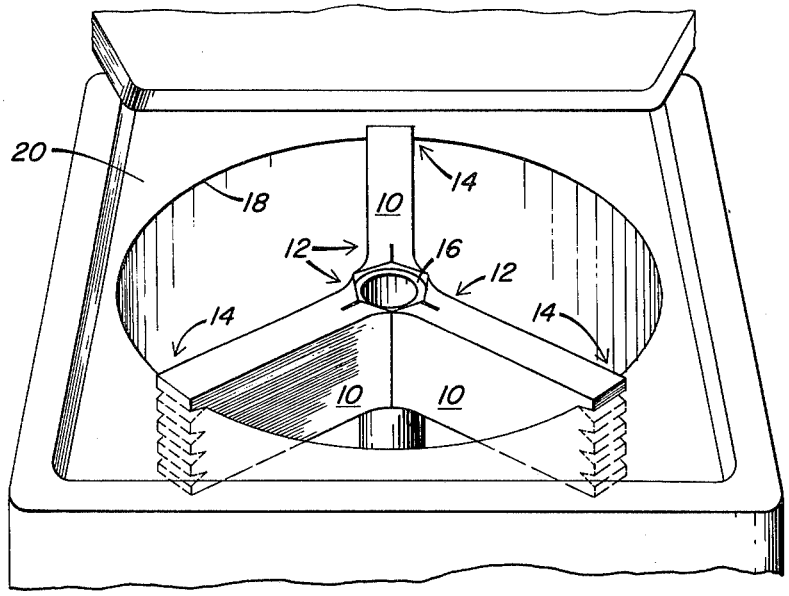
FIG. 1 is an illustration of the blocks of the present invention when fitted in a washing machine.

FIGS. 1 and 6–8 show the manner in which the braces 10 are arranged in the washing machine to support firmly the agitator. Each of the braces 10 has an inner end 12 and an outer end 14, the inner ends being adapted to bear against the agitator 16 and the outer ends being adapted to bear against the opening 18 in the machine housing 20 and the upper end of the clothes basket 22 of the machine (see FIG. 6). A number of braces 10 are disposed radially about the agitator 16. Typically three or four braces will be required, depending on the machine. In some instances only two braces may be required.

Figure 2:
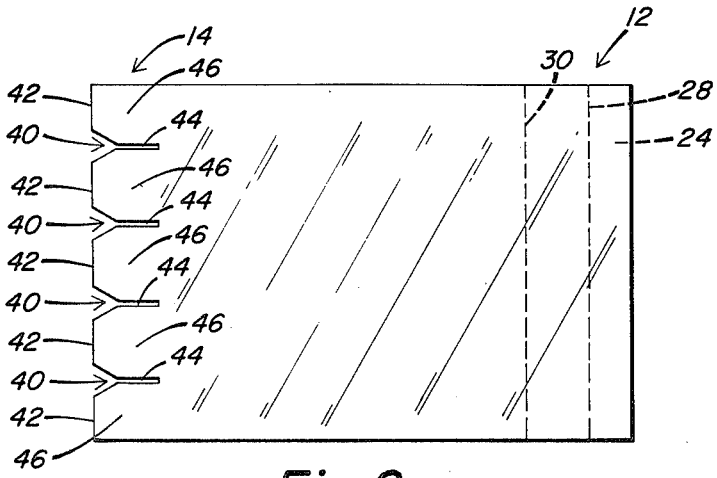
FIG. 2 is a side elevation of one of the blocks.
Figure 4:
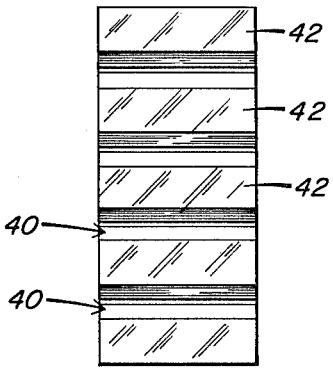
FIG. 4 is an end view of the outer end of one of the blocks.
Figure 3:
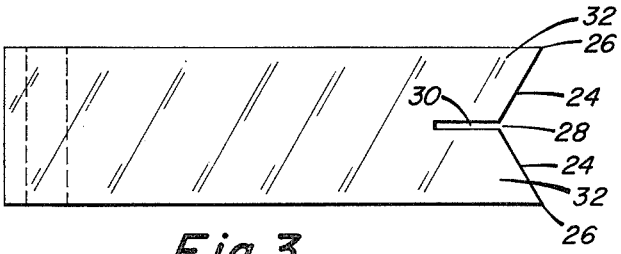
FIG. 3 is a top view of one of the blocks.
Figure 5:
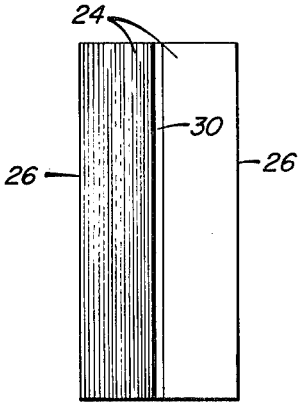
FIG. 5 is an end view of the inner end of one of the blocks.
Figure 6:
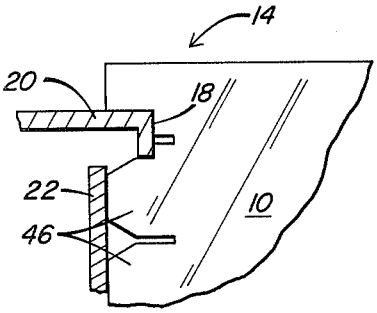
FIG. 6 is a somewhat diagrammatic illustration of the outer end of a block in engagement with the basket and housing of the machine.
Figure 7:
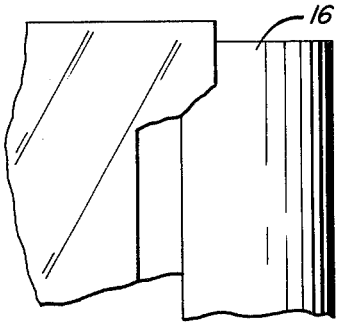
FIG. 7 is a somewhat diagrammatic illustration (partly broken away) of the inner end of a block in engagement with the agitator.
Figure 8:
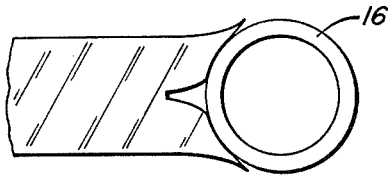
FIG. 8 is a plan view of the inner end of a block in engagement with the agitator.

As shown in FIGS. 2 and 3, each of the blocks has what may be considered as an inner, agitator-engaging end 12 and an outer, housing and basket-engaging end 14. The inner end 12 is provided with a vertically extending, generally V-shaped groove 24 which extends substantially from the corners 26 of the inner end to a vertex 28. Preferably, the V-shaped groove 24 defines an angle of the order of between 90° and 130°. A vertically extending slot 30 is formed in the block from the vertex of the groove 24 and extends from the vertex toward the outer end 14 of the block. The vertical V-groove 24 and the vertical slot 30 cooperate to define a pair of fingers 32 at the inner end of the block which, when the inner end 12 of the block is forced radially against the agitator, will cause the fingers 32 to separate to conform and grip the agitator 16.

The outer end 14 of the block is provided with a plurality of horizontally extending, vertically spaced V-shaped grooves 40 which are separated by a substantially flat, vertical outer surfaces 42. The outer end 14 of the block 10 may have of the order of three to five such grooves. Each of the grooves 40 preferably defines an angle of the order of 40° to 60°. Each of the grooves 40 is further provided with a slot 44 which extends from the vertex of the groove 40 toward the inner end 12 of the block 10. The slots 44 in the outer end of the block preferably are somewhat wider and not as deep as the vertical slot 30 associated with the inner end of the block. The horizontal V-grooves 40 and their associated horizontal slots 44 define a plurality of vertically spaced fingers 46 which are flexible and deformable independently of each other.

FIG. 1 illustrates the manner in which a plurality of the blocks 10 are used to rigidify the agitator 16 and basket of the top loading clothes washing machine. The blocks 10 are inserted one at a time and may be arranged in a Y-configuration as shown or in a crossed configuration when the particular installation requires four blocks. The blocks 10 are inserted one at a time. Each block may be inserted either with its outer end 14 first placed in engagement with the machine housing and basket and then urging its inner end 12 downwardly into engagement with the upper end of the agitator. Thus, the outer end 14 of the block first is urged against the housing of the machine with one of grooves 40 being engaged with the housing (see FIG. 6). The lower fingers 46 at the outer end of the block will engage the basket of the machine. After the outer end 14 is in place, the inner end 12 may be urged downwardly into engagement with the upper end of the agitator post 16 which will engage the groove 24 at the inner end and force the fingers 32 apart to an extent depending on the size and shape of the machine. When the block is urged firmly to a fully engaged position with the agitator the fingers 32 will be spread apart to engage the block firmly and the block will be somewhat radially compressed so that it remains securely in place. The remaining blocks 10 are inserted in the same way. Alternately, the installation procedure may be reversed in that the inner 12 end of the block 10 first may be engaged with the agitator post to force the inner fingers 32 apart and then the outer end 14 of the block 10 may be urged downwardly into engagement with the upper end of the housing and the basket.

It should be understood that the foregoing description of the invention is intended merely to be illustrative thereof and that other embodiments and modifications may be apparent to those skilled in the art without departing from its spirit.

Having thus described the invention, what I desire to claim and secure by Letters Patent is:

1. A bracing device for a top loading clothes washing machine having an agitator element comprising:

an elongate member formed from a relatively stiff but resiliently compressable foam plastic material, said member having an inner end and an outer end, said inner end being adapted to engage said agitator and the outer end being adapted to engage the rim of the opening of the washing machine so that when the brace is used it extends radially and outwardly from the agitator;

the inner end of the block being formed to define a vertically extending V-shaped groove adapted to engage the upper end of the agitator;

the outer end of the block being formed to define a plurality of horizontally extending vertically spaced V-shaped grooves adapted to engage the rim of the housing of the washing machine.

2. A device as defined in claim 1 further comprising:

a vertically extending slot at the inner end of the block extending from the vertex of the vertical V-shaped groove.

3. A device as defined in claim 2 further comprising:

a horizontal slot associated with each of the horizontal grooves at the outer end of the block.

* * * * *